US007008365B2

(12) United States Patent
Hamatschek et al.

(10) Patent No.: US 7,008,365 B2
(45) Date of Patent: Mar. 7, 2006

(54) CENTRIFUGE HAVING A FEELER ELEMENT FOR SENSING A MEDIUM LEVEL

(75) Inventors: Jochen Hamatschek, Oelde (DE); Willi Niemerg, Oelde (DE); Wilfried Mackel, Oelde (DE)

(73) Assignee: Westfalia Separator AG, Oelde (DE)

( * ) Notice: Subject to any disclaimer, the term of this patent is extended or adjusted under 35 U.S.C. 154(b) by 298 days.

(21) Appl. No.: 10/466,676

(22) PCT Filed: Jan. 8, 2002

(86) PCT No.: PCT/EP02/00080

§ 371 (c)(1),
(2), (4) Date: Jul. 21, 2003

(87) PCT Pub. No.: WO02/058852

PCT Pub. Date: Aug. 1, 2002

(65) Prior Publication Data

US 2004/0063562 A1 Apr. 1, 2004

(30) Foreign Application Priority Data

Jan. 27, 2001 (DE) ..... 101 03 769

(51) Int. Cl.
*B04B 9/14* (2006.01)

(52) U.S. Cl. ..... 494/10; 494/82

(58) Field of Classification Search ..... 494/1, 494/7, 10, 12, 60, 62, 68–70, 82, 84; 74/574; 210/97, 144

See application file for complete search history.

(56) References Cited

U.S. PATENT DOCUMENTS

| | | | | |
|---|---|---|---|---|
| 3,226,016 | A * | 12/1965 | Couper et al. |
| 3,559,808 | A * | 2/1971 | O'Conor et al. |
| 3,986,663 | A * | 10/1976 | Jonsson, deceased et al. |
| 4,206,871 | A * | 6/1980 | Nilsson |
| 4,410,318 | A * | 10/1983 | Bjork et al. |
| 4,522,620 | A * | 6/1985 | Leister |
| 4,900,453 | A * | 2/1990 | Sedlmayer |
| 5,736,054 | A * | 4/1998 | Feller et al. |
| 5,879,279 | A | 3/1999 | Berger et al. |
| 6,350,224 | B1 * | 2/2002 | Cordaro et al. |
| 6,390,964 | B1 * | 5/2002 | Mackel |
| 6,648,809 | B1 * | 11/2003 | Mackel et al. |
| 6,827,680 | B1 * | 12/2004 | Niemerg |
| 2004/0063562 | A1 * | 4/2004 | Hamatschek et al. |
| 2004/0176233 | A1 * | 9/2004 | Himmen et al. |

FOREIGN PATENT DOCUMENTS

DE 1 482 721 6/1969

(Continued)

*Primary Examiner*—Charles E. Cooley
(74) *Attorney, Agent, or Firm*—Barnes & Thornburg LLP

(57) ABSTRACT

A centrifuge that includes a centrifugal drum having a solids collecting chamber arranged below a bottom of the centrifugal drum. Also included is an oscillation measuring device for recording oscillations of the centrifugal drum. Further included is a medium situated in the solids collecting chamber. Also included is at least one feeler element that protrudes beyond the bottom of, and is connected to the centrifugal drum. When the medium level rises in the solids collecting chamber, the at least one feeler element is contacted by the medium before the medium contacts the centrifugal drum. The contact results in uncritical oscillations that are analyzed by the oscillation measuring device.

8 Claims, 2 Drawing Sheets

FOREIGN PATENT DOCUMENTS

| | | | | |
|---|---|---|---|---|
| DE | 3516735 | A1 | * | 11/1986 |
| DE | 37 37 002 | CA | | 1/1989 |
| DE | 39 25 198 | A2 | | 3/1991 |
| DE | 43 20 265 | A1 | | 12/1994 |
| DE | 199 22 237 | A1 | | 12/2000 |
| EP | 0 300 439 | A2 | | 1/1989 |
| EP | 0 300 439 | A3 | | 1/1989 |
| GB | 998669 | | | 7/1965 |
| WO | WO 99/52641 | | | 10/1999 |

* cited by examiner

CENTRIFUGE HAVING A FEELER ELEMENT FOR SENSING A MEDIUM LEVEL

BACKGROUND AND SUMMARY OF THE INVENTION

The present invention relates to a centrifuge having a centrifugal drum, a solids collecting chamber arranged below the centrifugal drum, and having an oscillation measuring device for recording oscillations of the centrifugal drum.

Centrifuges of the above-mentioned type are known.

In the case of centrifuges of this type, the oscillation measuring device can record and analyze oscillations caused by the centrifugal drum. Based on the analyzed results, a change of the operating parameters and, if required, a switching-off of the centrifuge will then be caused in order to avoid damage. Likewise, a warning signal can be activated causing operating personnel to check a centrifuge which is not running under optimal operating conditions.

If the level in the solids collecting chamber has risen to such an extent that the centrifugal drum itself comes in contact with the filled-in medium in the solids collecting tank, oscillations of an unacceptable intensity and strength may occur within a very short time. These oscillations may result in damage to the centrifuge because, under certain circumstances, the reaction times of the oscillation measuring device and of the control devices which follow may not be sufficient for preventing such damage.

The present invention further develops a centrifuge of the above-mentioned type such that an occurrence of oscillations of an unacceptable intensity and strength because of a contact of a centrifugal drum with a medium filled in the solids collecting chamber can be reliably avoided.

According to the present invention, at least one feeler element, which protrudes beyond a bottom or lowest plane of the centrifugal drum, is fastened to the centrifugal drum. When the level in the solids collecting chamber rises, this feeler element is contacted first by the medium situated in the solids collecting chamber so that, before the centrifugal drum is contacted by the medium, uncritical oscillations are generated which are recorded and analyzed by the oscillation measuring device.

As a result of the present invention, the centrifuge has a relatively simple construction and is cost-effective with respect to manufacturing aspects. In addition, before a contact between the centrifugal drum and the medium in the solids collecting chamber, oscillations of an absolutely uncritical intensity are generated which can be recorded and analyzed by the oscillation measuring device, so that major damage, as may occur during oscillations of an unacceptable intensity or strength, is avoided.

The invention will be better understood and appreciated from the following detailed descriptions and with reference to the accompanying drawings.

DETAILED DESCRIPTION OF THE PREFERRED EMBODIMENTS

Figure 1:
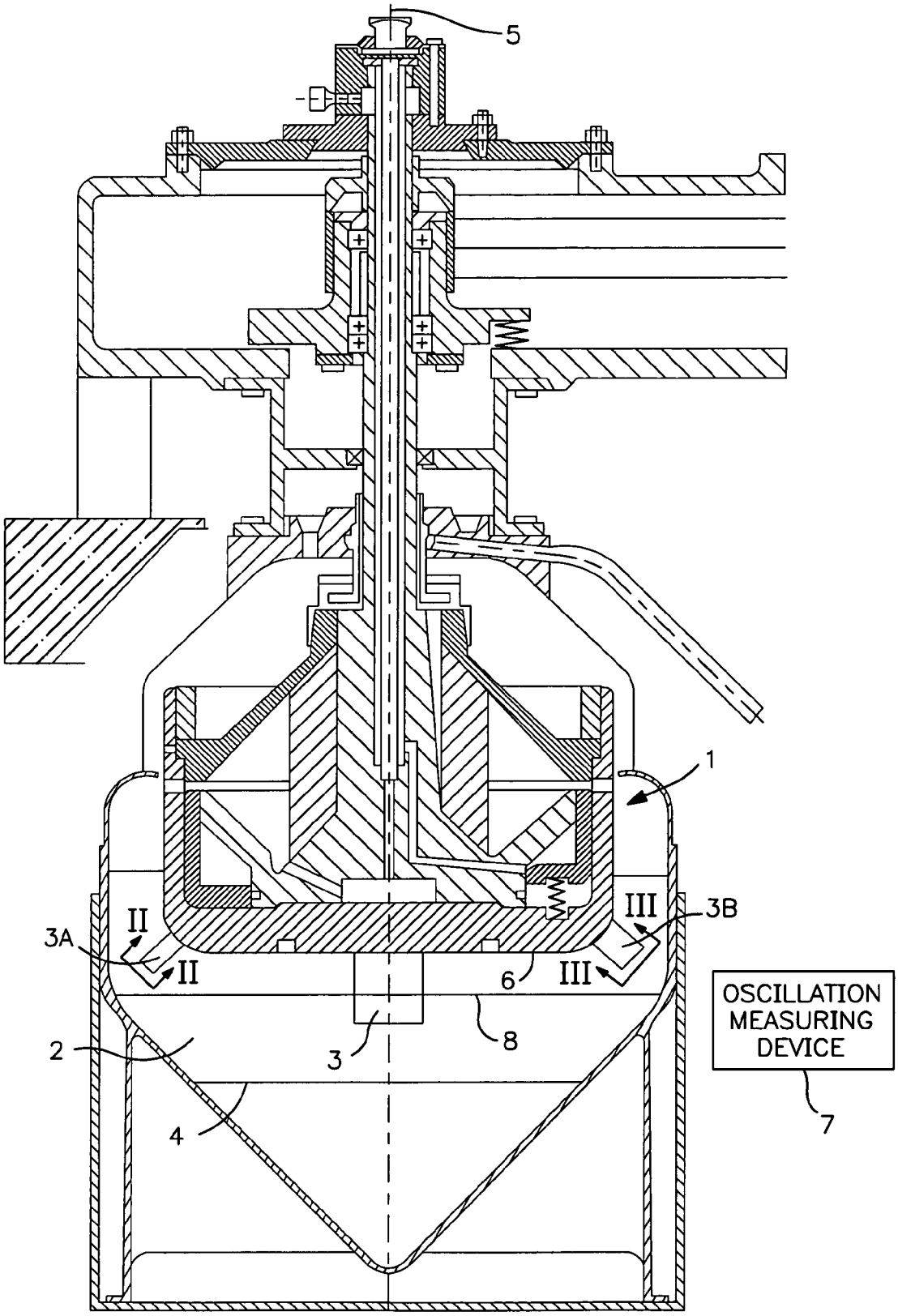
FIG. 1 is a sectional view of a centrifuge, according to the principles of the present invention.

The centrifuge shown in the Figure includes a centrifugal drum 1 which at least partially projects into a solids collecting chamber 2 arranged essentially below a bottom 6 of the centrifugal drum 1.

In addition, the centrifuge includes a known type of oscillation measuring device 7 (connection to the centrifuge not shown for sake of clarity) for recording oscillations of the centrifugal drum 1.

According to the invention, at least one feeler element 3, which protrudes beyond the bottom 6 or lowest plane of the centrifugal drum 1, is fastened to the centrifugal drum. When a level of medium 4 in the solids collecting chamber 2 rises, as indicated by the line 8, the at least one feeler element 3 is contacted first by the medium 4. When this occurs, slight uncritical oscillations are generated which can be recorded and analyzed by the oscillation measuring device 7.

As shown in the Figure, the at least one feeler element 3 may be arranged in an axis of rotation 5 of the centrifugal drum 1. Also shown are feeler elements 3A and 3B which may be arranged outside or spaced-apart from the axis of rotation 5 of the centrifugal drum 1.

It is possible to arrange two or more feeler elements 3, 3A, 3B on a common graduated circle. Likewise, it is possible to arrange two or more feeler elements 3, 3A, 3B of different dimensions on different graduated circles such that no unbalanced mass is thereby created.

Figure 2:
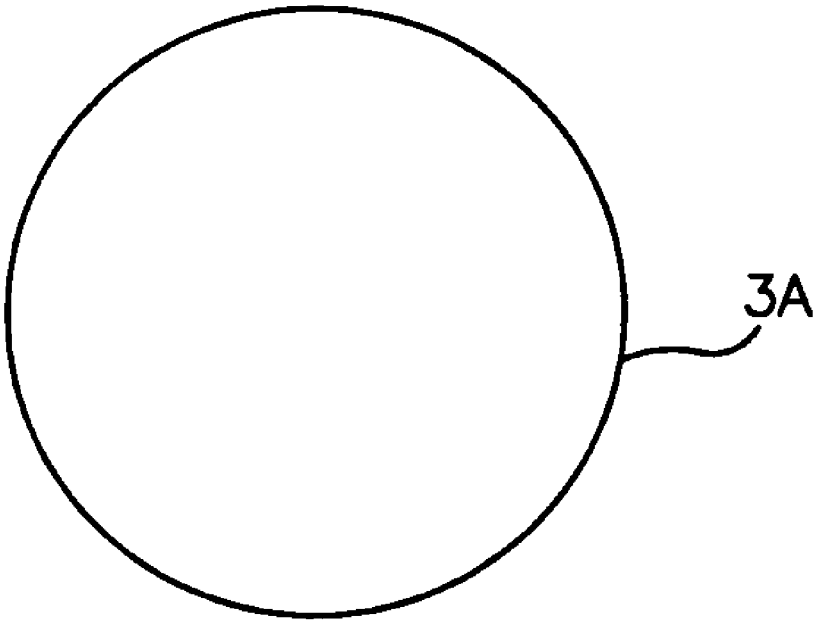
FIG. 2 is an end view taken along lines II—II of feeler element 3A in FIG. 1.
Figure 3:
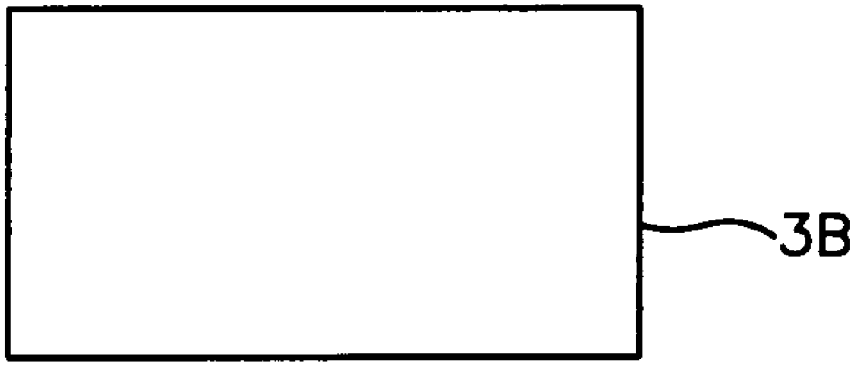
FIG. 3 is an end view taken along lines III—III of feeler element 3B in FIG. 1.

The feeler elements 3, 3A, 3B may have the shape of cylindrical pins. However, the feeler elements 3, 3A, 3B may also have other geometrical cross-sectional shapes, for example, non-circular. Thus, as shown in FIG. 2, feeler element or pin 3A has a cylindrical shape. As shown in FIG. 3, feeler element or pin 3B has a non-circular or rectangular cross-section.

The feeler elements 3, 3A, 3B may be selected as a function of a product to be centrifuged and/or as a function of the medium 4.

As mentioned above, one or more of feeler elements 3, 3A, 3B on the underside of the centrifugal drum 1 contacts the medium 4 rising in the solids collecting chamber 2 before the medium 4 contacts the centrifugal drum 1, thereby generating oscillations in an uncritical range which can be recorded and correspondingly analyzed by the oscillation measuring device 7 of the centrifuge 1.

Any known oscillation measuring device 7 can be used.

The term "oscillations", as used in the above description, includes vibrations.

Although the present disclosure has been described and illustrated in detail, it is to be clearly understood that this is done by way of illustration and example only and is not to be taken by way of limitation. The spirit and scope of the present disclosure are to be limited only by the terms of the appended claims.

We claim:

1. A centrifuge, comprising:

a centrifugal drum;

a solids collecting chamber arranged below a bottom of the centrifugal drum;

an oscillation measuring device for recording oscillations of the centrifugal drum; and at least one feeler element protruding beyond the bottom of and connected to the centrifugal drum, so that when a medium level in the solids collection chamber rises, the at least one feeler element is contacted by the medium before the medium contacts the centrifugal drum, and the contact results in uncritical oscillations that are analyzed by the oscillation measuring device.

2. The centrifuge according to claim 1, wherein the at least one feeler element is arranged in an axis of rotation of the centrifugal drum.

3. The centrifuge according to claim 2, wherein the at least one feeler element includes an additional two or more feeler elements arranged outside an axis of rotation of the centrifugal drum.

4. The centrifuge according to claim 1, wherein the at least one feeler element includes two or more feeler elements of different dimensions arranged on different graduated circles of the centrifugal drum.

5. The centrifuge according to claim 1, wherein the at least one feeler element has a shape of a cylindrical pin.

6. The centrifuge according to claim 1, wherein the at least one feeler element has the shape of a pin with a noncircular cross-section.

7. The centrifuge according to claim 1, wherein the at least one feeler element includes two or more feeler elements arranged outside an axis of rotation of the centrifugal drum.

8. The centrifuge according to claim 1, wherein the at least one feeler element includes three feeler elements.

* * * * *